US010474071B2

(12) United States Patent
Hayase et al.

(10) Patent No.: US 10,474,071 B2
(45) Date of Patent: Nov. 12, 2019

(54) FIXING DEVICE HAVING SHEET SEPARATION MEMBERS WHICH ARE DISPLACED BY DIFFERENT AMOUNTS ACCORDING TO A CHANGE IN DIAMETER OF A HEATED ROTATOR, AND IMAGE FORMING APPARATUS

(71) Applicant: KONICA MINOLTA, INC., Chiyoda-ku, Tokyo (JP)

(72) Inventors: Toru Hayase, Toyohashi (JP); Koji Yamamoto, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/439,619

(22) Filed: Feb. 22, 2017

(65) Prior Publication Data

US 2017/0277086 A1 Sep. 28, 2017

(30) Foreign Application Priority Data

Mar. 22, 2016 (JP) ..... 2016-057186

(51) Int. Cl.
*G03G 15/20* (2006.01)
*G03G 21/16* (2006.01)
*G03G 15/00* (2006.01)

(52) U.S. Cl.
CPC ..... *G03G 15/2028* (2013.01); *G03G 15/2017* (2013.01); *G03G 15/6573* (2013.01);
(Continued)

(58) Field of Classification Search
CPC ..... G03G 15/2017; G03G 15/2028; G03G 15/2085; G03G 15/6573; G03G 21/1685;
(Continued)

(56) References Cited

U.S. PATENT DOCUMENTS 8,204,418 B2 * 6/2012 Nakajima ..... G03G 15/2028 399/323

FOREIGN PATENT DOCUMENTS

JP H1083127 A 3/1998
JP 2009258396 A 11/2009
(Continued)

OTHER PUBLICATIONS

Japanese Office Action dated Sep. 24, 2019 (and English translation thereof) issued in Japanese Application No. 2016-057186.

*Primary Examiner* — Joseph S Wong
(74) *Attorney, Agent, or Firm* — Holtz, Holtz & Volek PC

(57) ABSTRACT

A fixing device is configured to fix a toner image to a sheet by heat and includes: a heating rotator; a pressurizing roller contacting with the heating rotator; a heater configured to heat the heating rotator such that the heat is transferred to the sheet passing through a contact portion between the heating rotator and the pressurizing roller; a plurality of separation claws configured to separate the sheet from the heating rotator such that the sheet passing through the contact portion is not caught in the heating rotator, the separation claws being provided opposite to the heating rotator; and an adjustor configured to adjust positions of the separation claws relative to the heating rotator such that distances between the separation claws and the heating rotator are equal to each other.

12 Claims, 17 Drawing Sheets

(52) U.S. Cl.
CPC ..... *G03G 21/1685* (2013.01); *G03G 2215/00413* (2013.01); *G03G 2221/1639* (2013.01); *G03G 2221/1672* (2013.01)

(58) Field of Classification Search
CPC . G03G 2215/00413; G03G 2221/1639; G03G 2221/1672
See application file for complete search history.

(56) References Cited

FOREIGN PATENT DOCUMENTS

| | | | |
|---|---|---|---|
| JP | 2011180344 | A | 9/2011 |
| JP | 2012133201 | A | 7/2012 |
| JP | 2013057775 | A | 3/2013 |
| JP | 2014215355 | A | 11/2014 |

* cited by examiner

FIG.8

| SHEET | SHEET PASSING AREA | TEMPERATURE AT FIXING BELT | THERMAL EXPANSION AMOUNT | GAP | SEPARATIVENESS |
|---|---|---|---|---|---|
| LARGE SHEET | A1 (CENTER PORTION) | 160°C | 0.8mm | 1.0mm | GOOD |
| | A2 (END PORTION) | 160°C | 0.8mm | 1.0mm | GOOD |
| SMALL SHEET | A1 (CENTER PORTION) | 160°C | 0.8mm | 1.4mm | POOR |
| | A2 (END PORTION) | 230°C | 1.2mm | 1.0mm | – |

FIG.9

| SHEET | SHEET PASSING AREA | TEMPERATURE AT FIXING BELT | THERMAL EXPANSION AMOUNT | GAP | SEPARATIVENESS |
|---|---|---|---|---|---|
| LARGE SHEET | A1 (CENTER PORTION) | 160°C | 0.8mm | 1.0mm | GOOD |
| | A2 (END PORTION) | 160°C | 0.8mm | 1.0mm | GOOD |
| SMALL SHEET | A1 (CENTER PORTION) | 160°C | 0.8mm | 1.0mm | GOOD |
| | A2 (END PORTION) | 230°C | 1.2mm | 1.0mm | – |

FIXING DEVICE HAVING SHEET SEPARATION MEMBERS WHICH ARE DISPLACED BY DIFFERENT AMOUNTS ACCORDING TO A CHANGE IN DIAMETER OF A HEATED ROTATOR, AND IMAGE FORMING APPARATUS

This application is based on Japanese Patent Application No. 2016-057186 filed with the Japan Patent Office on Mar. 22, 2016, the entire content of which is hereby incorporated by reference.

BACKGROUND OF THE INVENTION

Field of the Invention

The present disclosure relates to an image forming apparatus, and particularly to a fixing device included in an electrophotographic image forming apparatus.

Description of the Related Art

An electrophotographic image forming apparatus performs, as a printing process, a step of forming a toner image on a photosensitive body according to an input image, a step of primarily transferring the toner image on the photosensitive body to a transfer belt, a step of secondarily transferring the toner image on the transfer belt to a sheet, and a step of fixing the toner image to the sheet by heat using a fixing device.

The fixing device includes a heating rotator and a pressurizing roller. The heating rotator includes a heater. The heating rotator heated with the heater transfers heat to a sheet that passes through a contact portion (hereinafter, also referred to as a fixing nip) between the heating rotator and the pressurizing roller. Therefore, the toner is melted and fixed onto the sheet.

Recently, the fixing device including separation members becomes widespread. The separation members are linearly disposed opposite to the heating rotator, and separate the sheet from the heating rotator such that the sheet passing through the fixing nip is not caught in the heating rotator.

As to the fixing device including the separation member, Japanese Laid-Open Patent Publication No. 2013-57775 discloses a fixing device in which the separation member favorably separates a recording medium from a heating member without damaging the heating member even if a temperature of the surface of the heating member changes. Japanese Laid-Open Patent Publication No. 2014-215355 discloses a fixing device capable of suppressing abrasion of a surface of a heating member. Japanese Laid-Open Patent Publication No. 2012-133201 discloses a fixing device capable of maintaining good separativeness while the rotator is not damaged even if a recording medium comes into contact with the rotator. Japanese Laid-Open Patent Publication No. 2009-258396 discloses a fixing device in which a distance between a sheet conveying member and the separation member is controlled to prevent the abrasion and wear of the sheet conveying member caused by the separation member.

A gap (hereinafter, also referred to as a separation gap) is provided between the heating rotator and the separation member. For the large separation gap, the sheet enters the separation gap to cause a sheet jam. On the other hand, for the small separation gap, when the heating rotator is thermally expanded, the separation member comes into contact with the heating rotator to damage the heating rotator. Accordingly, desirably the separation gap is always kept constant.

The sheet takes heat from the heating rotator when passing through the fixing nip. For this reason, when the sheets having various sizes pass through the fixing nip, temperature unevenness occurs in the surface of the heating rotator to vary a degree of thermal expansion in different positions in the heating rotator. Resultantly, the separation gap varies in different positions in the heating rotator.

In the fixing devices of Japanese Laid-Open Patent Publication Nos. 2013-57775, 2014-215355, 2012-133201, and 2009-258396, the positions of the separation members cannot individually be adjusted. Therefore, when the sheets having various sizes pass through the fixing nip, the separation gap varies in different positions in the heating rotator. In this case, a sheet jam is highly likely to occur. Thus, there is a demand for a technique capable of suppressing the sheet jam even if the sheets having various sizes pass through the fixing nip.

SUMMARY OF THE INVENTION

The present disclosure has been made to solve the above-mentioned disadvantage and an object of one aspect is to provide a fixing device capable of more suppressing the occurrence of the sheet jam than before. An object of another aspect is to provide an image forming apparatus capable of more suppressing the occurrence of the sheet jam than before.

According to one aspect, a fixing device is configured to fix a toner image to a sheet by heat, and includes: a first rotator; a second rotator contacting with a rotating surface of the first rotator; a heating unit configured to heat the first rotator such that the heat is transferred to the sheet passing through a contact portion between the first rotator and the second rotator; a plurality of separation members configured to separate the sheet from the first rotator such that the sheet passing through the contact portion is not caught in the first rotator, the plurality of separation members being provided opposite to the rotating surface of the first rotator; and an adjustor configured to adjust positions of the plurality of separation members relative to the first rotator such that distances between the plurality of separation members and the first rotator are equal to each other.

Preferably, the adjustor decreases a displacement of a first separation member of the plurality of separation members in a direction separating from the first rotator to be smaller than a displacement of a second separation member of the plurality of separation members in the direction. The first separation member is provided opposite to a first area, and the first area is an area through which a sheet of a first size passes in the contact portion. The second separation member is provided opposite to a second area and the second area is an area through which a sheet of a second size larger than the first size passes in the contact portion, and the second area is different from the first area.

Preferably, the fixing device further includes: a holding member provided opposite to the first rotator, the plurality of separation members being provided in the holding member; and an abutment member provided in the holding member and in contact with the first rotator. The abutment member, the holding member, and the plurality of separation members operate in conjunction with a change in diameter of the first rotator in a contact portion between the first rotator and the abutment member.

Preferably, the adjustor includes an obstruction member configured to obstruct the displacement of the first separation member such that a distance between the first separation member and the first rotator is not longer than a predetermined distance.

Preferably, the abutment member is in contact with both ends in the rotating surface of the first rotator.

Preferably, the fixing device further includes a plurality of distance sensors. Each of the plurality of distance sensors is provided so as to correspond to any of the plurality of separation members to detect a distance between the corresponding separation member and the first rotator. The adjustor includes a plurality of drivers. Each of the plurality of drivers is provided so as to correspond to any of the plurality of separation members, and drives the corresponding separation member such that distances detected with the plurality of distance sensors are equal to each other.

Preferably, the fixing device further includes a plurality of temperature sensors. Each of the plurality of temperature sensors is provided so as to correspond to any of the plurality of separation members to detect a surface temperature at the first rotator facing the corresponding separation member. The adjustor includes a plurality of drivers. Each of the plurality of drivers is provided so as to correspond to any of the plurality of separation members, and drives the corresponding separation member based on a temperature detected with each of the plurality of temperature sensors.

Preferably, the fixing device further includes a detector configured to detect a size of the sheet. When the detected sheet size is the second size, the adjustor decreases the displacement of the first separation member in the direction separating from the first rotator to be smaller than the displacement of the second separation member in the direction.

According to another aspect, an image forming apparatus includes the fixing device.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 8 is a view illustrating an experimental result of the fixing device of the comparative example.

FIG. 9 is a view illustrating an experimental result of the fixing device of the first embodiment.

DESCRIPTION OF THE PREFERRED EMBODIMENTS

Figure 1:
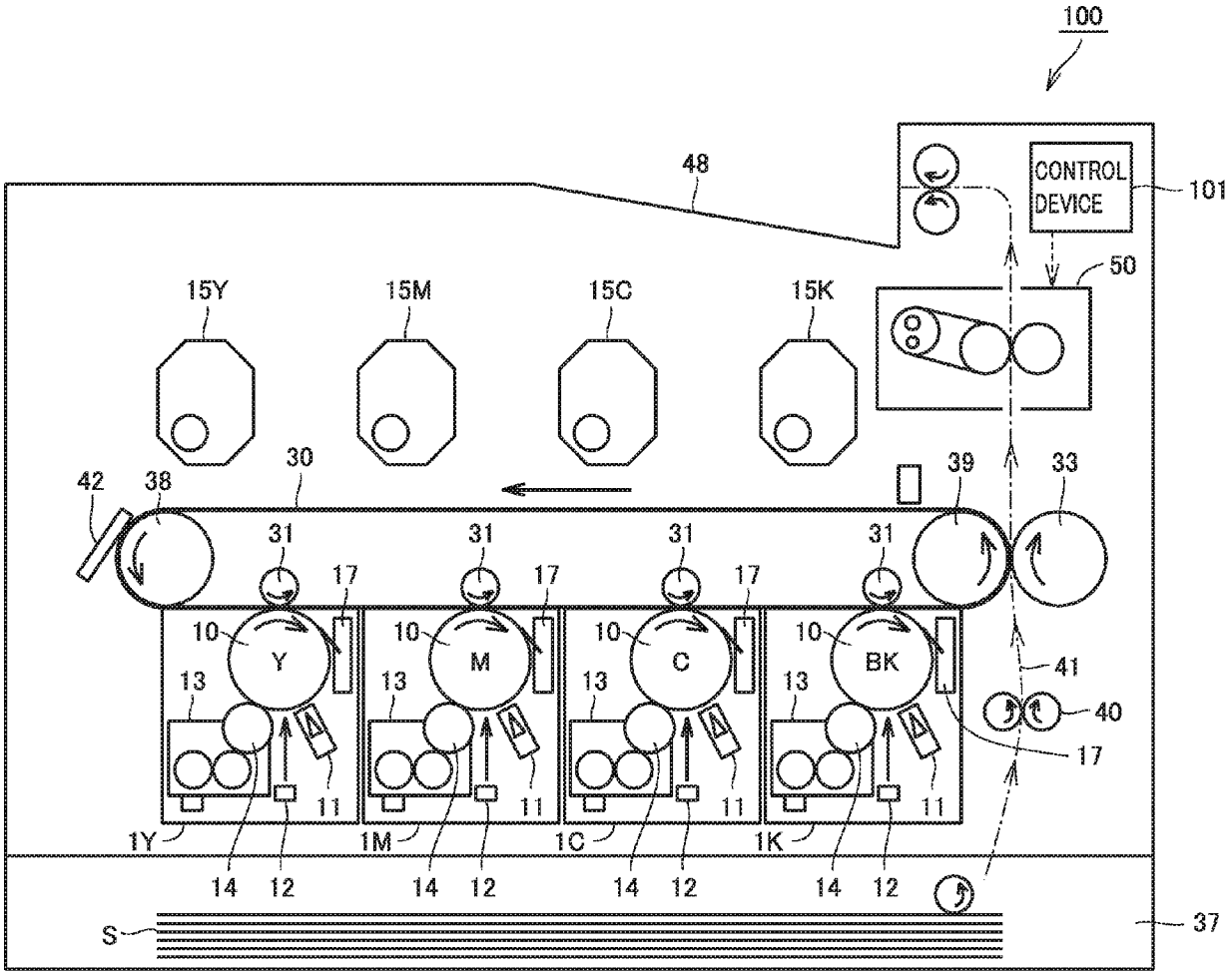
FIG. 1 is a view illustrating an example of an internal structure of an image forming apparatus according to a first embodiment.

Hereinafter, embodiments of the present invention will be described with reference to the accompanying drawings. In the following description, the same component is designated by the same reference numeral. The same holds true for the name and function. Accordingly, the overlapping description of the same component is omitted. The following embodiments and modifications may selectively be combined as appropriate.

<First Embodiment>

[Internal Structure of Image Forming Apparatus 100]

Referring to FIG. 1, an image forming apparatus 100 according to a first embodiment will be described below. FIG. 1 is a view illustrating an example of an internal structure of image forming apparatus 100.

FIG. 1 illustrates image forming apparatus 100 as a color printer. Although image forming apparatus 100 as the color printer will be described below, image forming apparatus 100 is not limited to the color printer. For example, image forming apparatus 100 may be a monochrome printer, a facsimile machine, a monochrome printer, or a multi-functional peripheral (MFP) in which the color printer and the facsimile machine are combined.

Image forming apparatus 100 includes image forming units 1Y, 1M, 1C, and 1K, an intermediate transfer belt 30, a primary transfer roller 31, a secondary transfer roller 33, a cassette 37, a driven roller 38, a driving roller 39, a timing roller 40, a cleaning blade 42, a fixing device 50, and a control device 101.

Image forming unit 1Y receives supply of toner from a toner bottle 15Y to form a yellow (Y) toner image. Image forming unit 1M receives supply of toner from a toner bottle 15M to form a magenta (M) toner image. Image forming unit 1C receives supply of toner from a toner bottle 15C to form a cyan (C) toner image. Image forming unit 1K receives supply of toner from a toner bottle 15K to form a black (BK) toner image.

Image forming units 1Y, 1M, 1C, and 1K are sequentially disposed in a rotation direction of intermediate transfer belt 30 along intermediate transfer belt 30. Each of image forming units 1N, 1M, 1C, and 1K includes a photosensitive body 10, a charger 11, an exposure unit 12, a development unit 13, and a cleaning blade 17.

Charger 11 uniformly charges a surface of photosensitive body 10. Exposure unit 12 irradiates photosensitive body 10 with a laser beam according to the control signal from control device 101, and exposes the surface of photosensitive body 10 according to an input image pattern. Therefore, an electrostatic latent image is formed on photosensitive body 10 according to an input image.

Development unit 13 applies a development bias to a development roller 14 while rotating development roller 14, and causes the toner to adhere to the surface of development roller 14. Therefore, the toner is transferred from development roller 14 to photosensitive body 10, and the toner image is developed on the surface of photosensitive body 10 according to the electrostatic latent image.

Photosensitive body 10 and intermediate transfer belt 30 are in contact with each other in a portion in which primary transfer roller 31 is provided. Primary transfer roller 31 is configured to be rotatable. A transfer voltage having an opposite polarity to the toner image is applied to primary transfer roller 31, whereby the toner image is transferred from photosensitive body 10 to intermediate transfer belt 30. The yellow (Y) toner image, the magenta (M) toner image, the cyan (C) toner image, and the black (BK) toner image sequentially overlapped one another, and transferred from photosensitive body 10 to intermediate transfer belt 30. Therefore, a color toner image is formed on intermediate transfer belt 30.

Intermediate transfer belt 30 is entrained about driven roller 38 and driving roller 39. Driving roller 39 is connected to a motor (not illustrated). Intermediate transfer belt 30 and driven roller 38 rotate in conjunction with driving roller 39. Therefore, the toner image on intermediate transfer belt 30 is conveyed to secondary transfer roller 33.

Cleaning blade 17 is brought into press contact with photosensitive body 10. Cleaning blade 17 recovers the toner remaining on the surface of photosensitive body 10 after the toner image is transferred from photosensitive body 10 to intermediate transfer belt 30.

Sheets S are set in cassette 37. Timing roller 40 feeds sheets S one by one from cassette 37 to secondary transfer roller 33 along a conveyance path 41. Control device 101 controls the transfer voltage applied to secondary transfer roller 33 in synchronization with timing of feeding sheet S.

Secondary transfer roller 33 is configured to be rotatable. Secondary transfer roller 33 applies the transfer voltage having the opposite polarity to the toner image to currently-conveyed sheet S. Therefore, the toner image is attracted from intermediate transfer belt 30 to secondary transfer roller 33 to transfer the toner image on intermediate transfer belt 30. The timing of conveying sheet S to secondary transfer roller 33 is controlled with timing roller 40 according to a position of the toner image on intermediate transfer belt 30. Resultantly, the toner image on intermediate transfer belt 30 is transferred to a proper position of sheet S.

Fixing device 50 pressurizes and heats sheet S that passes through fixing device 50. In response to a control signal from control device 101, fixing device 50 controls a heating level of the sheet and a pressure applied to the sheet. Fixing device 50 pressurizes and heats sheet S to fix the toner image to sheet S. Then, sheet S is discharged to a tray 48.

Cleaning blade 42 is brought into press contact with intermediate transfer belt 30. Cleaning blade 42 recovers the toner remaining on the surface of intermediate transfer belt 30 after the toner image is transferred from intermediate transfer belt 30 to sheet S. The recovered toner is conveyed with a conveying screw (not illustrated), and stored in a waste toner container (not illustrated).

[Fixing Device 50]

Figure 2:
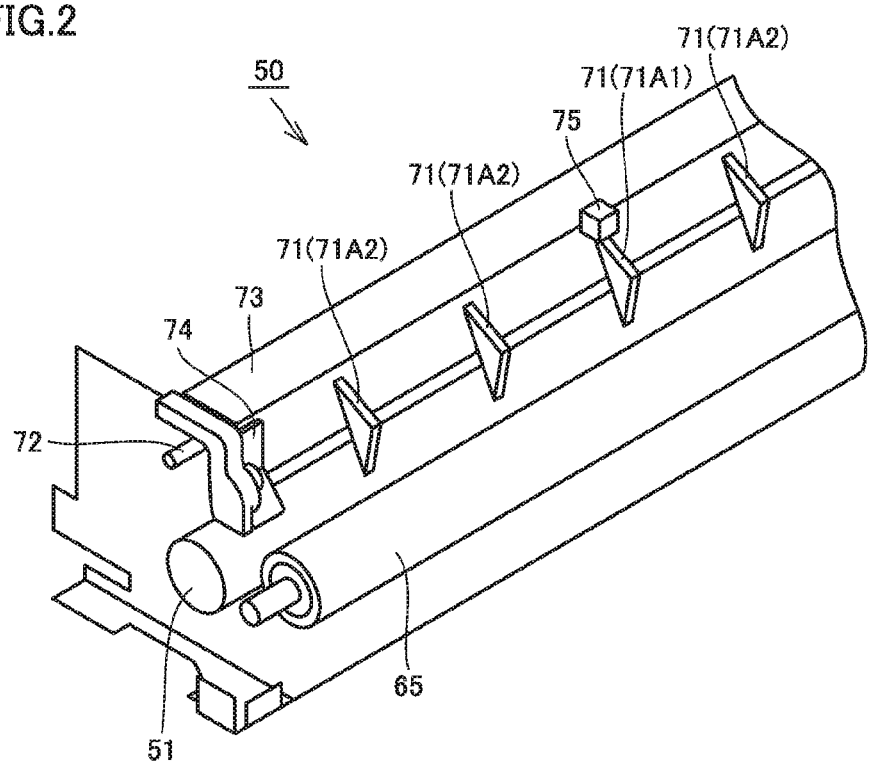
FIG. 2 is a perspective view illustrating an internal structure of a fixing device of the first embodiment.
Figure 3:
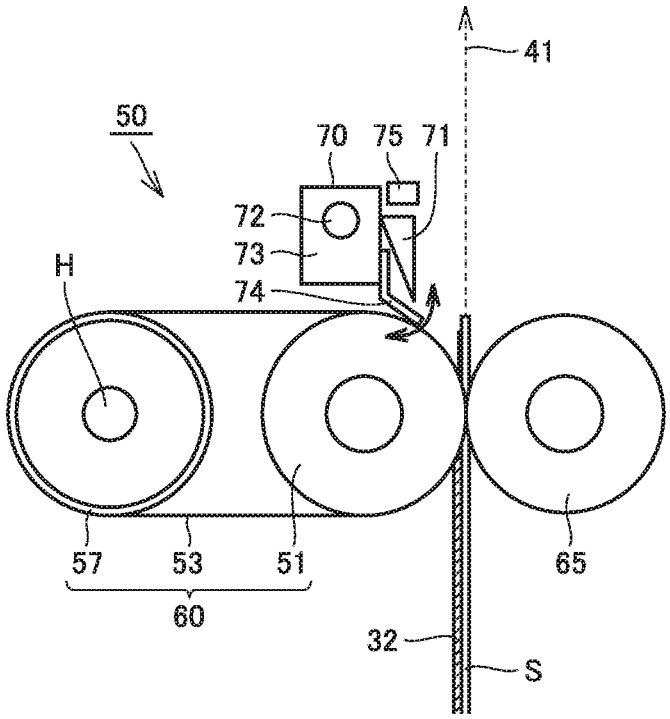
FIG. 3 is a side view illustrating the internal structure of the fixing device of the first embodiment.
Figure 4:
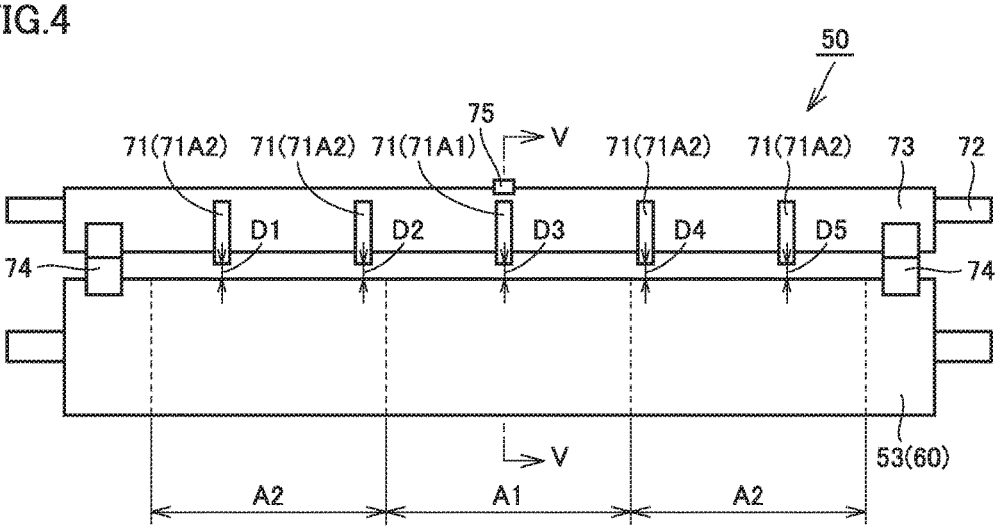
FIG. 4 is a view illustrating a configuration around a heating rotator included in the fixing device of the first embodiment.

Referring to FIGS. 2 to 4, fixing device 50 will be described in more detail. FIG. 2 is a perspective view illustrating an internal structure of fixing device 50. FIG. 3 is a side view illustrating the internal structure of fixing device 50. FIG. 4 is a view illustrating a configuration around a heating rotator 60 included in fixing device 50.

Heating rotator 60 is provided in fixing device 50. Heating rotator 60 is constructed with a fixing roller 51, a fixing belt 53, and a heating roller 57. Heating roller 57 includes a heater H (heating unit). Any number of heaters H may be used. For example, heater H is a halogen heater. Heater H (heating unit) heats heating rotator 60 such that the heat is transferred to sheet S that passes through a contact portion between heating rotator 60 and a pressurizing roller 65. More specifically, heater H heats heating roller 57 to transfer heat to fixing belt 53. Heated fixing belt 53 rotates to transfer the heat to fixing roller 51, and transfers the heat to sheet S conveyed on conveyance path 41. The sheet S is heated to melt toner image 32 on sheet S. Resultantly, toner image 32 is fixed to sheet S.

Pressurizing roller 65 is provided in fixing device 50. Pressurizing roller 65 (second rotator) is provided in contact with heating rotator 60 (first rotator). Pressurizing roller 65 pressurizes sheet S, which passes through the contact portion between heating rotator 60 and pressurizing roller 65, against fixing roller 51.

A holding member 73 is provided opposite to heating rotator 60. Holding member 73 is configured to be rotatable about a shaft 72. A plurality of separation claws 71 (separation members) are provided in holding member 73. Preferably, separation claws 71 are provided at equal intervals. Separation claw 71 is provided opposite to heating rotator 60, and separates sheet S that passes through the contact portion between heating rotator 60 and pressurizing roller 65 from heating rotator 60 such that sheet S is not caught in heating rotator 60. Separation gaps are provided at predetermined intervals (for example, 1.0 mm) between heating rotator 60 and separation claw 71 such that fixing belt 53 is not damaged by separation claw 71.

An abutment member 74 is provided in holding member 73. Abutment member 74 is in contact with heating rotator 60. More specifically, abutment members 74 are provided at both ends of holding member 73 in an extending direction of shaft 72, and are in contact with both ends of a rotating surface of heating rotator 60. Abutment member 74 is displaced according to thermal expansion between both the ends of heating rotator 60. Separation claw 71 and holding member 73 are displaced in conjunction with abutment member 74. That is, separation claw 71, holding member 73, and abutment member 74 operate in conjunction with a change in diameter of heating rotator 60 in the contact portion between heating rotator 60 and abutment member 74.

When the sheets having various sizes are printed, temperature unevenness occurs in the surface of fixing roller 51 to vary a degree of thermal expansion in different positions in heating rotator 60. Therefore, when all separation claws 71 are displaced in the same way, separation gaps D1 to D5 vary in each separation claw 71. Accordingly, fixing device 50 individually adjusts each position of separation claw 71 with respect to heating rotator 60 such that separation gaps D1 to D5 are equal to one another. Various methods are adopted as a position adjusting unit (adjustor) of separation claw 71. FIGS. 2 to 4 illustrate an obstruction member 75 as an example of the position adjusting unit. Obstruction member 75 will be described in detail later. When separation gaps D1 to D5 are kept constant, fixing device 50 can prevent the sheet from entering separation gaps D1 to D5. Resultantly, the occurrence of the sheet jam is suppressed. Additionally, when separation gaps D1 to D5 are kept constant, fixing device 50 can prevent the contact between heating rotator 60 and separation claw 71. Resultantly, fixing device 50 can prevent separation claw 71 from damaging heating rotator 60.

It is assumed that a sheet passing area A1 is an area through which the sheet having a first size (for example, A4 size) passes in the contact portion (that is, the fixing nip) between heating rotator 60 and pressurizing roller 65. For example, the first size corresponds to a minimum size in printable sheet sizes. The sheet having the first size is also referred to as a small sheet. In the fixing nip, it is assumed that a sheet passing area A2 is an area through which the sheet having second size (for example, A3 size) larger than first size (for example, A4 size) passes, and is an area except for sheet passing area A1. For example, the second size corresponds to a maximum size in printable sheet sizes. The sheet having the second size is also referred to as a large sheet. In separation claws 71, it is assumed that a separation claw 71A1 (first separation member) is separation claw 71 provided opposite to sheet passing area A1. In separation claws 71, it is assumed that a separation claw 71A2 (second separation member) is separation claw 71 provided opposite to sheet passing area A2.

When passing through the fixing nip, the small sheet takes the heat from sheet passing area A1. At this point, because the small sheet does not take the heat from sheet passing area A2, a temperature at sheet passing area A2 is higher than a temperature at sheet passing area A1. Therefore, sheet passing area A1 is larger than sheet passing area A2 in the degree of thermal expansion of heating rotator 60. Resultantly, separation gaps D1, D2, D4, and D5 in sheet passing area A2 are longer than separation gap D3 in sheet passing area A1. Preferably, in the position adjusting unit of separation claw 71, a displacement of separation claw 71A1 in a direction separating from heating rotator 60 is decreased to be smaller than a displacement of separation claw 71A2 in the direction separating from heating rotator 60. Therefore, the differences among separation gaps D1 to D5 are reduced.

FIGS. 2 to 4 illustrate obstruction member 75 as an example of the position adjusting unit of separation claw 71. Obstruction member 75 is provided opposite to heating rotator 60. Separation claw 71A1 is disposed between obstruction member 75 and heating rotator 60. For example, obstruction member 75 is fixed to a casing (not illustrated) of fixing device 50. That is, obstruction member 75 does not operate in conjunction with separation claw 71 and holding member 73. Obstruction member 75 obstructs the displacement of separation claw 71A1 such that separation gap D3 between separation claw 71A1 and heating rotator 60 is not longer than a predetermined distance (for example, 1.0 mm). Therefore, the displacement of separation claw 71A2 is smaller than the displacement of separation claw 71A1, which results in the decrease in the differences among separation gaps D1 to D5.

In the example of FIGS. 2 to 4, only one obstruction member 75 is provided for separation claws 71. Alternatively, obstruction member 75 may be provided for each separation claw 71. In this case, preferably, obstruction members 75 are disposed into an arch shape. More specifically, each obstruction member 75 is disposed such that, before start of the heating (that is, before start of the printing), the distance between separation claw 71 and obstruction member 75 is increased toward separation claw 71 provided outside.

[Separation Claw 71]

Figure 5:
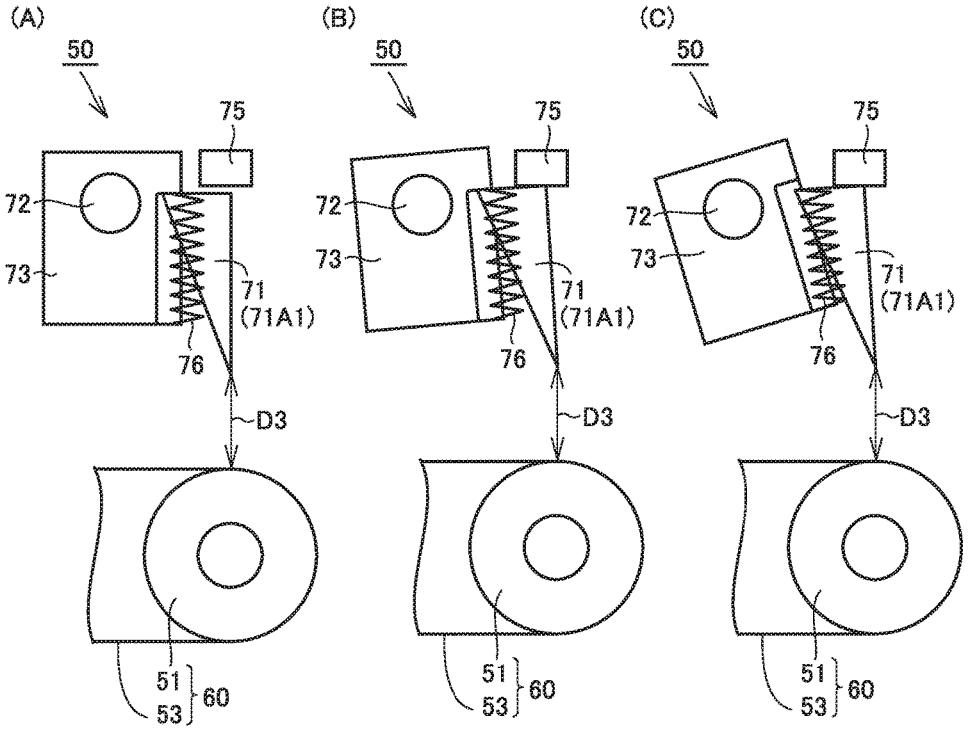
FIG. 5 is a sectional view taken along line V-V in FIG. 4

Referring to FIG. 5, action of separation claw 71A1 in a printing process will be described below. FIG. 5 is a sectional view taken along line V-V in FIG. 4.

FIG. 5(A) illustrates a state of separation claw 71A1 before the printing is started (that is, before the heating of heating rotator 60 is started). As illustrated in FIG. 5(A), separation claw 71A1 and holding member 73 are connected to each other with a spring 76. More specifically, one end of spring 76 is fixed to separation claw 71A1. The other end of spring 76 is fixed to a lower portion of a groove formed in holding member 73.

In image forming apparatus 100, the heating of heating rotator 60 is started based on a printing instruction received from a user. Heating rotator 60 is thermally expanded with increasing temperature at heating rotator 60. Holding member 73 rotates about shaft 72 in association with the thermal expansion of the end portion of heating rotator 60. Separation claw 71A1 operates in conjunction with the rotation of holding member 73. As illustrated in FIG. 5(B), when the thermal expansion of the end portion of heating rotator 60 is increased, separation claw 71A1 comes into contact with obstruction member 75.

As illustrated in FIG. 5(C), after separation claw 71A1 contacts with obstruction member 75, separation claw 71A1 is not displaced even if the thermal expansion of the end portion of heating rotator 60 is further increased. Therefore, obstruction member 75 can prevent the separation claw 71A1 from operating in conjunction with separation claw 71A2 (see FIG. 4), and separation gaps D1 to D5 (see FIG. 4) are individually adjusted.

[Comparative Experiment]

Figure 6:
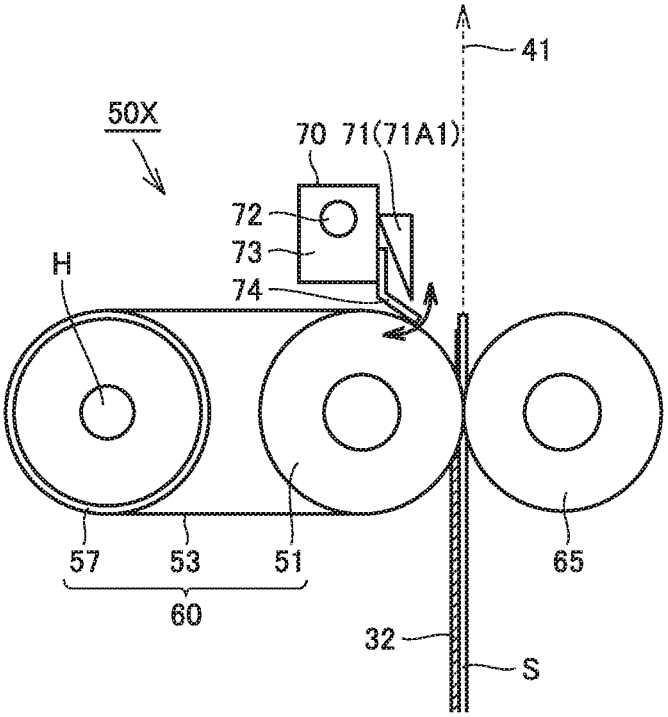
FIG. 6 is a side view illustrating an internal structure of a fixing device according to a comparative example.
Figure 7:
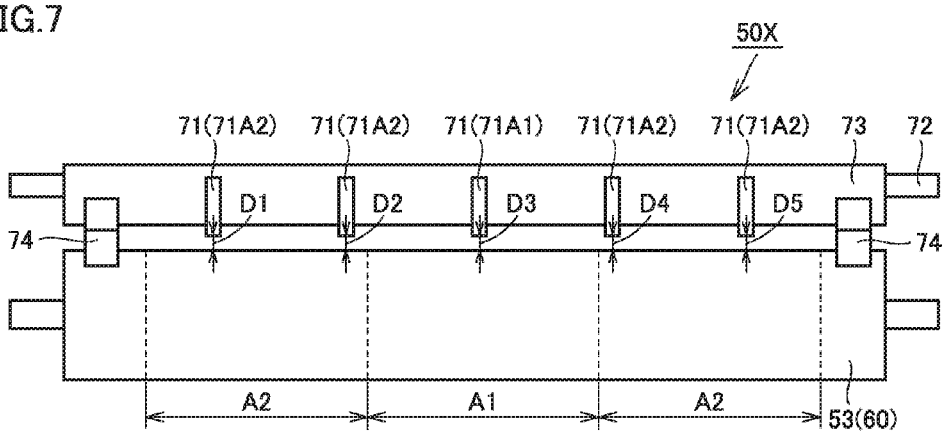
FIG. 7 is a view illustrating a configuration around a heating rotator included in the fixing device of the comparative example.

Referring to FIGS. 6 to 9, a comparison result between fixing device 50 of the first embodiment and a fixing device 50X of the comparative example will be described below. FIG. 6 is a side view illustrating an internal structure of fixing device 50X of the comparative example. FIG. 7 is a view illustrating a configuration around a heating rotator 60 included in fixing device 50X of the comparative example. FIG. 8 is a view illustrating an experimental result of fixing device 50X of the comparative example. FIG. 9 is a view illustrating an experimental result of fixing device 50 of the first embodiment.

As illustrated in FIGS. 6 and 7, fixing device SOX of the comparative example differs from fixing device 50 of the first embodiment in that obstruction member 75 is not provided. Other configurations of fixing device 50X are similar to those of fixing device 50.

A comparative experiment between fixing devices 50 and 50X was performed under the following conditions;

Fixing roller 51 has an outer diameter of 33 mm. A solid cored bar is provided in a center of fixing roller 51. Fixing roller 51 is made of a silicone rubber layer and a surface layer. The silicone rubber layer has a thickness of 4 mm. The surface layer is made of a silicone sponge rubber. The surface layer has a thickness of 2 mm.

Fixing belt 53 has an inner diameter of 50 mm. Fixing belt 53 is made of a base layer, a silicone rubber layer, and a surface layer. The base layer has a thickness of 60 μm. The silicone rubber layer has a thickness of 150 μm. The surface layer has a thickness of 15 μm. The silicone rubber layer has a thickness of 150 μm. A tension of 50 N is necessary for fixing roller 51 and heating roller 57 to stretch fixing belt 53.

Heating roller 57 has an outer diameter of 18 mm. A cored bar (not illustrated) of heating roller 57 has a thickness of 0.3 mm. An inner surface of heating roller 57 is painted in black. A surface of heating roller 57 is painted with PFA (perfluoroalkoxy fluororesin).

There are two heaters H. One of heaters H is a 1200-W halogen heater, and has a length of 300 mm. The other heater H is an 800-W halogen heater, and has a length of 180 mm.

Pressurizing roller 65 has an outer diameter of 36 mm. A solid cored bar is provided in the center of pressurizing roller 65. Pressurizing roller 65 is made of a silicone rubber layer and a surface layer. The silicone rubber layer has a thickness of 6 mm. The surface layer has a thickness of 30 μm. Pressurizing roller 65 presses heating rotator 60 with 400 N. The contact portion (that is, the fixing nip) between pressurizing roller 65 and heating rotator 60 has a width of 12 mm in the sheet conveying direction. Heating rotator 60 rotates while being driven by pressurizing roller 65. A sheet conveying speed is 300 mm/s.

As illustrated in FIG. 8, when the large sheets are continuously printed, a temperature at fixing belt 53 (see FIG. 4) is 160° C. in both sheet passing areas A1 and A2 (see FIG. 4). The diameter of heating rotator 60 (see FIG. 4) is lengthened by 0.8 mm compared with room temperature. Both the separation gaps of sheet passing areas A1 and A2 are 1.0 mm. In this case, the separation gap is equalized in different positions in heating rotator 60, and the separativeness of the sheet from heating rotator 60 is better.

When the small sheets are continuously printed, the temperature at fixing belt 53 is 160° C. in sheet passing area A1, and is 230° C. in sheet passing area A2. In sheet passing area A1, the diameter of heating rotator 60 is lengthened by 0.8 mm compared with room temperature, and the separation gap is 1.4 mm. In sheet passing area A2, the diameter of heating rotator 60 is lengthened by 1.2 mm compared with room temperature, and the separation gap is 1.0 mm. Thus, in fixing device SOX of the comparative example, when the small sheets are continuously printed, the separation gap in sheet passing area A1 is longer than the separation gap in sheet passing area A2. Resultantly, there is a high possibility that the sheet enters the gap between heating rotator 60 and separation claw 71, so that the sheet jam easily occurs.

On the other hand, in fixing device 50 of the first embodiment, even if the small sheets are continuously printed, the separation gap is 1.0 mm in both sheet passing areas A1 and A2. The separation gap is always kept constant to prevent the sheet from entering the separation gap, and therefore, the occurrence of the sheet jam is suppressed.

[Summary of First Embodiment]

As described above, fixing device 50 of the first embodiment individually adjusts the positions of separation claws 71 (see FIG. 4) such that separation gaps D1 to D5 (see FIG. 4) are equal to one another. When separation gaps D1 to D5 are kept constant, fixing device 50 can prevent the sheet from entering separation gaps D1 to D5 to suppress the occurrence of the sheet jam. Additionally, when separation gaps D1 to D5 are kept constant, fixing device 50 can prevent separation claw 71 from damaging heating rotator 60.

In fixing device 50 of the first embodiment, it is not necessary to provide a driving component (such as a motor) of separation claw 71 in order to keep separation gaps D1 to D5 constant, but separation gaps D1 to D5 can be kept constant only by the mechanical configuration. Therefore, a malfunction of the driving component of separation claw 71 or a software bug does not occur, but reliability is enhanced in fixing device 50.

<Second Embodiment>

[Fixing Device 50]

Figure 10:
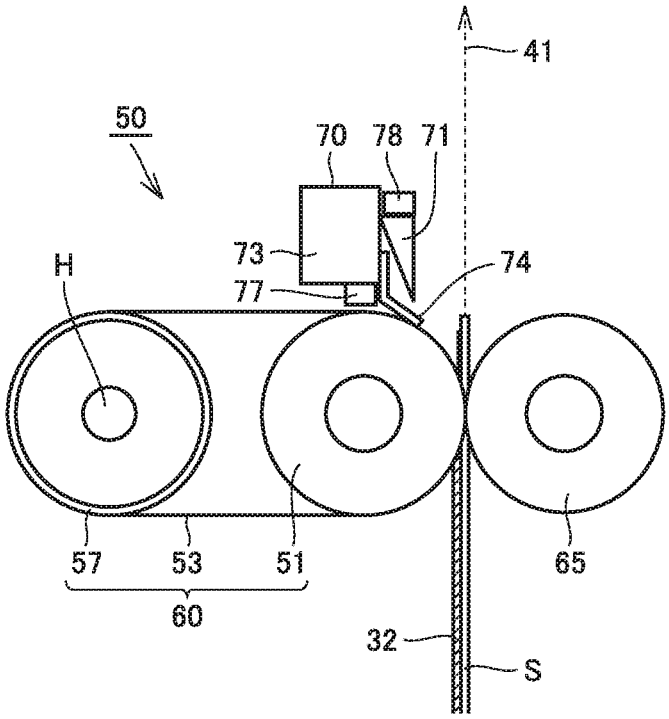
FIG. 10 is a side view illustrating an internal structure of a fixing device according to a second embodiment.
Figure 11:
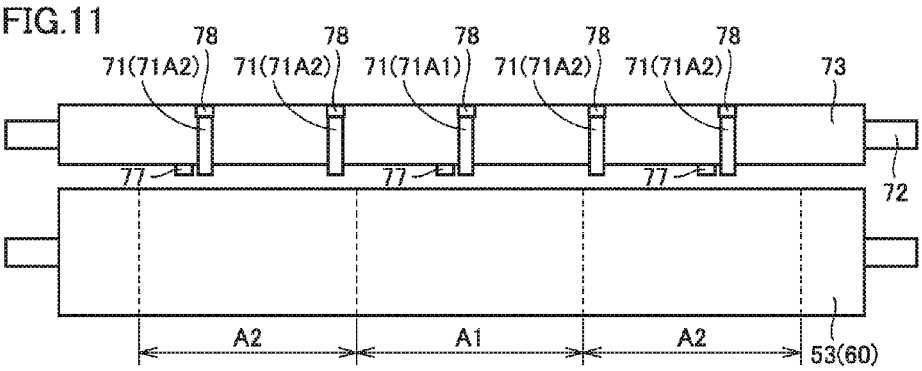
FIG. 11 is a view illustrating a configuration around a heating rotator included in the fixing device of the second embodiment.

Referring to FIGS. 10 and 11, a fixing device 50 according to a second embodiment will be described below. FIG. 10 is a side view illustrating an internal structure of fixing device 50 of the second embodiment. FIG. 11 is a view illustrating a configuration around heating rotator 60 included in fixing device 50 of the second embodiment.

As illustrated in FIGS. 10 and 11, fixing device 50 of the second embodiment differs from fixing device 50 of the first embodiment in that fixing device 50 of the second embodiment includes an actuator 78 (driver) that drives separation claw 71, instead of obstruction member 75. A distance sensor 77 is further provided in fixing device 50 of the second embodiment. Because other configurations are similar to those of fixing device 50 of the first embodiment, the overlapping description is omitted.

A plurality of distance sensors 77 are provided in fixing device 50. Each of distance sensors 77 is provided so as to correspond to any of separation claws 71. Distance sensor 77 detects the distance (that is, the separation gap) between corresponding separation claw 71 and heating rotator 60. Preferably, each distance sensor 77 is provided adjacent to corresponding separation claw 71. At least two distance sensors 77 are provided. Preferably, the number of distance sensors 77 is equal to the number of separation claws 71.

A plurality of actuators 78 (drivers) are provided in fixing device 50. Each of actuators 78 is provided so as to correspond to any of separation claws 71. Preferably, the number of actuators 78 is equal to the number of separation claws 71. Actuator 78 drives corresponding separation claw 71 such that the separation gaps detected with distance sensors 77 are equal to one another. Therefore, separation gaps D1 to D5 are equal to one another even if the degree of thermal expansion varies in different positions in heating rotator 60.

[Hardware Configuration of Image Forming Apparatus 100]

Figure 12:
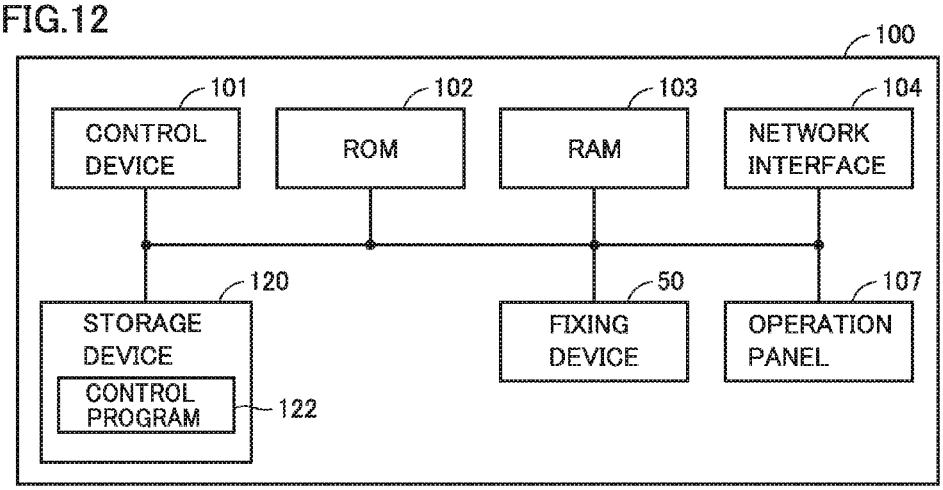
FIG. 12 is a block diagram illustrating a main hardware configuration of the image forming apparatus of the second embodiment.

Referring to FIG. 12, an example of a hardware configuration of image forming; apparatus 100 will be described below. FIG. 12 is a block diagram illustrating a main hardware configuration of image forming apparatus 100.

As illustrated in FIG. 12, image forming apparatus 100 includes a control device 101, a read only memory (ROM) 102, a random access memory (RAM) 103, a network interface 104, an operation panel 107, and a storage device 120.

For example, control device 101 includes at least one integrated circuit. For example, the integrated circuit includes at least one central processing unit (CPU), at least one application specific integrated circuit (ASIC), at least one field programmable gate array (FPGA), or a combination thereof.

Control device 101 controls action of image forming apparatus 100 by executing various programs such as a control program 122 of the second embodiment. Control device 101 reads control program 122 from storage device 120 to ROM 102 based on reception of a command to execute control program 122. RAM 103 acts as a working memory to temporarily store various pieces of data necessary for the execution of control program 122 therein.

An antenna (not illustrated) or the like is connected to network interface 104. Image forming apparatus 100 exchanges the data with an external communication device through the antenna. For example, the external communication device includes a mobile communication terminal such as a smartphone, and a server. Image forming apparatus 100 may be configured to be able to download control program 122 from the server through the antenna.

Operation panel 107 includes a display and a touch panel. The display and the touch panel overlap each other. For example, operation panel 107 receives a printing operation, a scan operation, or the like with respect to image forming apparatus 100.

Storage device 120 is a storage medium such as a hard disk and an external storage device. Control program 122 of the second embodiment is stored in storage device 120. A storage place of control program 122 is not limited to storage device 120, but control program 122 may be stored in a storage area (such as a cache) of control device 101, ROM 102, RAM 103, an external device (such as a server), or the like.

Control program 122 is not provided as a single program, but may be provided by being incorporated in a part of any program. In this case, control processing of the second embodiment is performed in conjunction with any program, Even the program that does not partially include module is also included in the scope of control program 122 of the second embodiment. A part or whole of the function provided by control program 122 may be implemented by dedicated hardware. Image forming apparatus 100 may be configured in such a form as what is called cloud service in which at least one server partially performs the processing of control program 122.

[Control Structure of Image Forming Apparatus 100]

Figure 13:
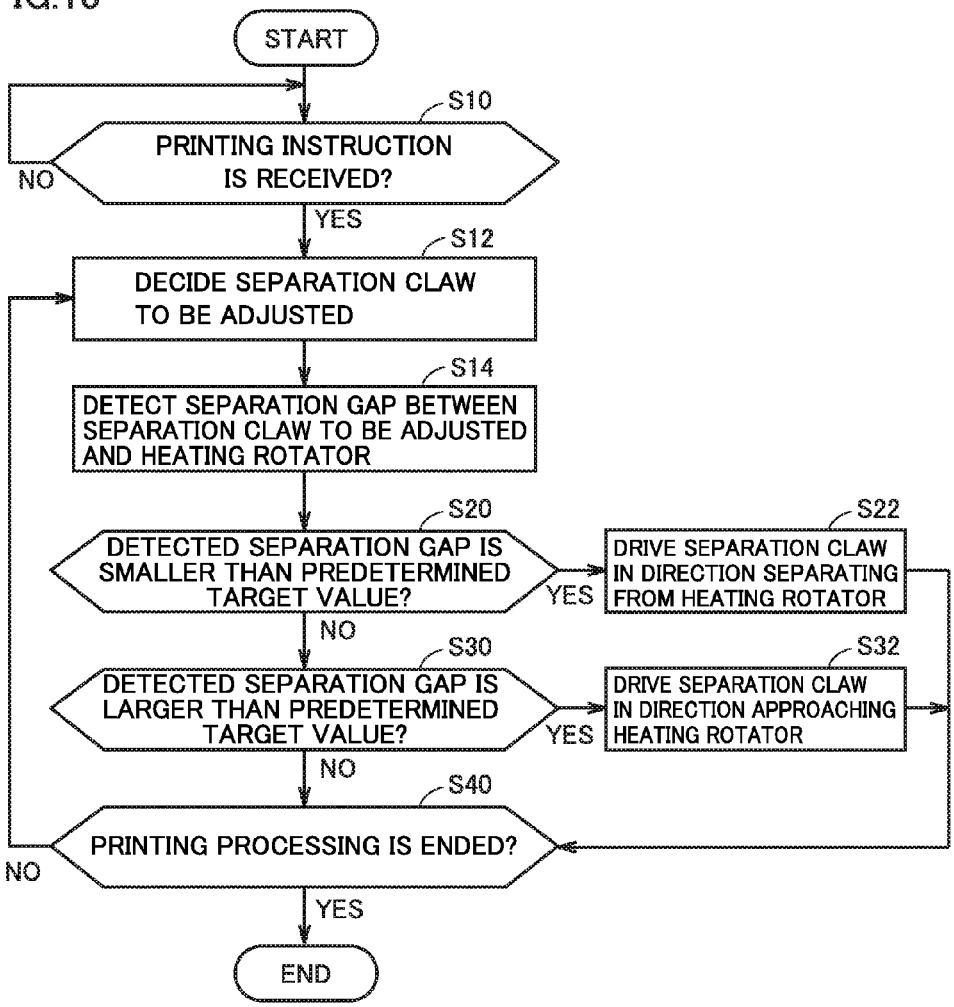
FIG. 13 is a flowchart partially illustrating processing performed with a control device of the image forming apparatus of the second embodiment.

Referring to FIG. 13, a control structure of image forming apparatus 100 of the second embodiment will be described below. FIG. 13 is a flowchart partially illustrating processing performed with control device 101 (FIG. 1) of image forming apparatus 100 of the second embodiment. Control device 101 executes control program 122 (see FIG. 12) to perform the processing in FIG. 13. In another aspect, a part or whole of the processing may be performed with a circuit element or hardware except for the circuit element.

In step S10, control device 101 determines whether the printing instruction is instructed from a user of image forming apparatus 100. When determining that the printing instruction is received from the user of image forming apparatus 100 (YES in step S10), control device 101 switches the control to step S12. When determining that the printing instruction is not received (NO in step S10), control device 101 performs the processing in step S10 again.

In step S12, control device 101 decides the separation claw to be adjusted from separation claws 71. Control device 101 sequentially decides separation claws 71 as the adjustment target according to predetermined order.

In step S14, control device 101 causes distance sensor 77 corresponding to separation claw 71 to be adjusted to detect the distance (that is, the separation gap) between separation claw 71 to be adjusted and heating rotator 60.

In step S20, control device 101 determines whether the separation gap detected in step S14 is smaller than a predetermined target value (for example, 1.0 mm). When determining that the separation gap detected in step S14 is smaller than the predetermined target value (YES in step S20), control device 101 switches the control to step S22. When the separation gap is not smaller than the predetermined target value (NO in step S20), control device 101 switches the control to step S30.

In step S22, control device 101 controls actuator 78 that drives separation claw 71 to be adjusted, and drives separation claw 71 to be adjusted in the direction separating from heating rotator 60. Separation claw 71 to be adjusted is driven only by a value in which the separation gap detected in step S14 is differentiated from the predetermined target value.

In step S30, control device 101 determines whether the separation gap detected in step S14 is larger than a predetermined target value (for example, 1.0 mm). When determining that the separation gap detected in step S14 is larger than the predetermined target value (YES in step S30), control device 101 switches the control to step S32. When the separation gap is not larger than the predetermined target value (NO in step S30), control device 101 switches the control to step S40.

In step S32, control device 101 controls actuator 78 that drives separation claw 71 to be adjusted, and drives separation claw 71 to be adjusted in a direction approaching heating rotator 60. Separation claw 71 to be adjusted is driven only by a value in which the predetermined target value is differentiated from the separation gap detected in step S14.

In step S40, control device 101 determines whether printing processing is ended. When determining that the printing processing is ended (YES in step S40), control device 101 ends the control processing of the second embodiment. When the printing processing is not ended (NO in step S40), control device 101 returns the control to step S12.

[Summary of Second Embodiment]

As described above, fixing device 50 of the second embodiment drives each separation claw 71 such that separation gaps D1 to D5 (see FIG. 11) detected with distance sensors 77 are equal to one another. The separation gap is directly detected with distance sensor 77, so that fixing device 50 can correctly adjust the position of each separation claw 71.

Because actuator 78 is provided in each separation claw 71, a freedom degree of the position adjustment of separation claw 71 is improved. Therefore, the position adjusting processing of the second embodiment can be applied in various fixing devices. For example, the position adjusting processing of the second embodiment can be applied to not only fixing device 50 in which the small sheet is conveyed to sheet passing area A1 (see FIG. 4), but also fixing device 50 in which the small sheet is conveyed to sheet passing area A2 (see FIG. 4).

<Third Embodiment>

[Fixing Device 50]

Figure 14:
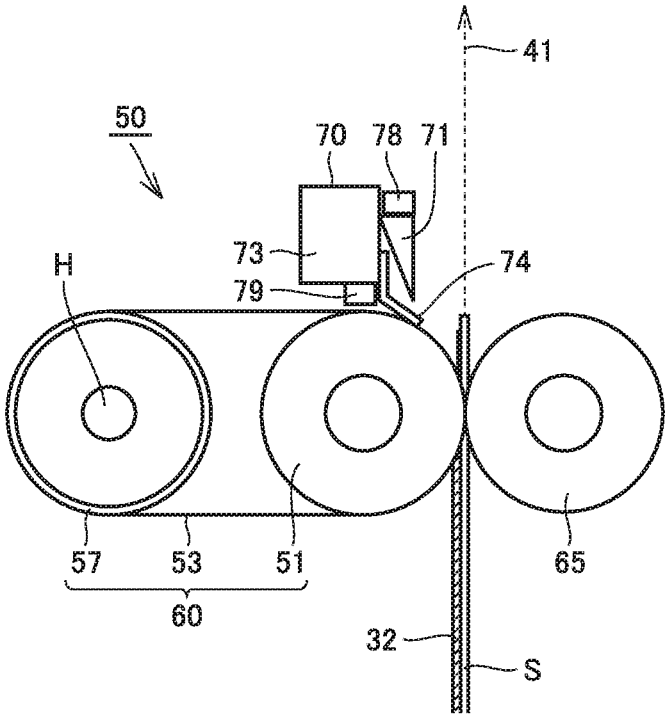
FIG. 14 is a side view illustrating an internal structure of a fixing device according to a third embodiment.
Figure 15:
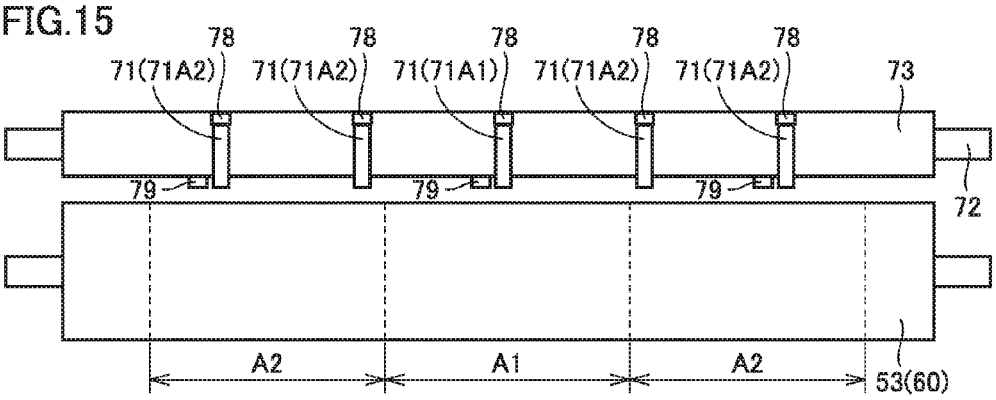
FIG. 15 is a view illustrating a configuration around a heating rotator included in the fixing device of the third embodiment.

Referring to FIGS. 14 and 15, a fixing device 50 according to a third embodiment will be described below. FIG. 14 is a side view illustrating an internal structure of fixing device 50 of the third embodiment. FIG. 15 is a view illustrating a configuration around heating rotator 60 included in fixing device 50 of the third embodiment.

As illustrated in FIGS. 14 and 15, fixing device 50 of the third embodiment differs from fixing device 50 of the second embodiment in that fixing device 50 of the third embodiment includes a temperature sensor 79 instead of distance sensor 77. Because other configurations such as a hardware configuration are similar to those of fixing device 50 of the second embodiment, the overlapping description is omitted.

A plurality of temperature sensors 79 are provided in fixing device 50. Each of temperature sensors 79 is provided so as to correspond to any of separation claws 71. Temperature sensor 79 detects the surface temperature at heating rotator 60 facing corresponding separation claw 71. Preferably, each temperature sensor 79 is provided adjacent to corresponding separation claw 71. At least two temperature sensors 79 are provided. Preferably, the number of temperature sensors 79 is equal to the number of separation claws 71. Sometimes, a temperature detecting function of heating rotator 60 is mounted on a general fixing device. In such cases, it is not necessary to newly provide temperature sensor 79. Fixing device 50 or image forming apparatus 100 is produced at low cost using an existing temperature detecting unit.

A plurality of actuators 78 (drivers) are provided in fixing device 50. Each of actuators 78 is provided so as to correspond to any of separation claws 71. The number of actuators 78 is equal to the number of separation claws 71. Each actuator 78 drives corresponding separation claw 71 based on a temperature detected with corresponding temperature sensor 79. More specifically, when the temperature detected with corresponding temperature sensor 79 is higher than a predetermined temperature, actuator 78 drives corresponding separation claw 71 in the direction separating from heating rotator 60. On the other hand, when the temperature detected with corresponding temperature sensor 79 is lower than the predetermined temperature, actuator 78 drives corresponding separation claw 71 in the direction approaching heating rotator 60. Separation claw 71 is driven every time the temperature detected with corresponding temperature sensor 79 changes.

[Control Structure of Image Forming Apparatus 100]

Figure 16:
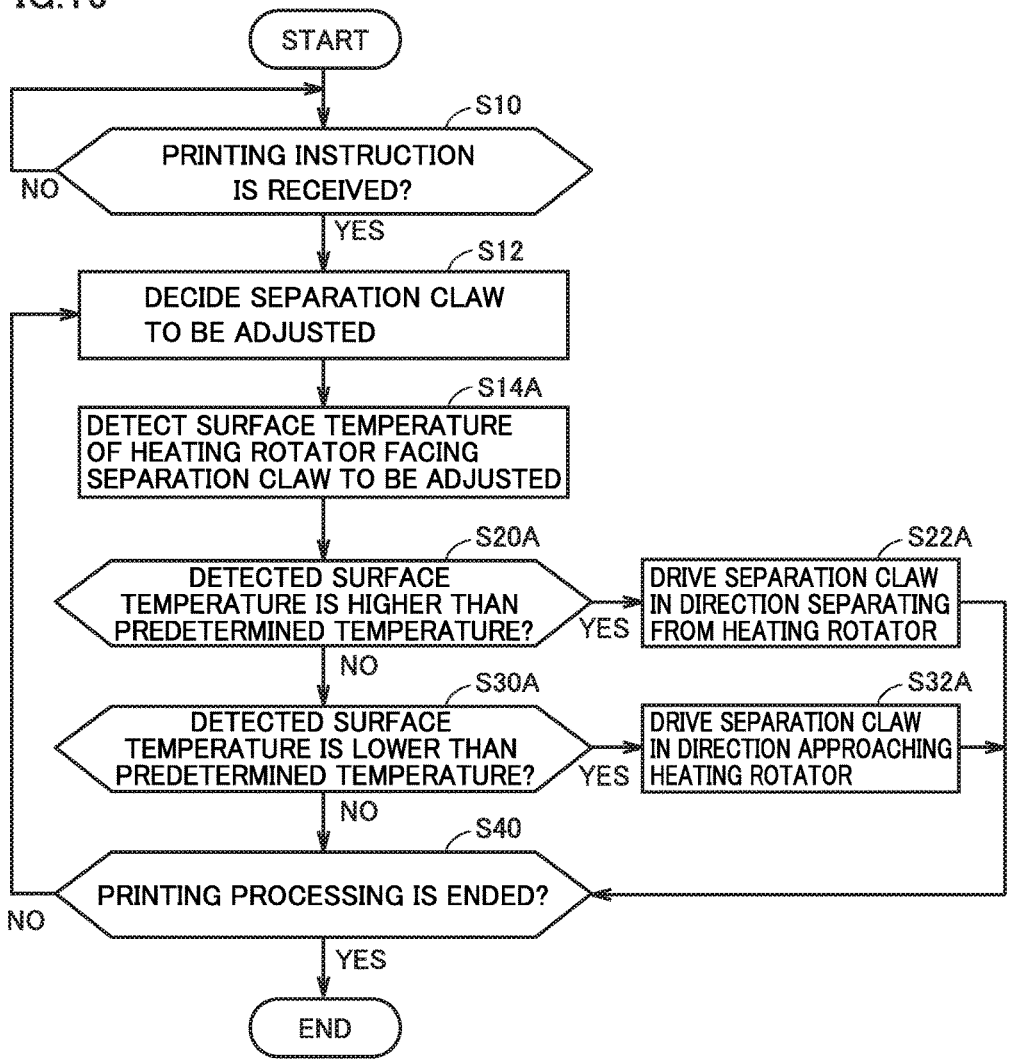
FIG. 16 is a flowchart partially illustrating processing performed with a control device of the image forming apparatus of the third embodiment.

Referring to FIG. 16, a control structure of image forming apparatus 100 of the third embodiment will be described below. FIG. 16 is a flowchart partially illustrating processing performed with control device 101 (FIG. 1) of image forming apparatus 100 of the third embodiment. Control device 101 executes control program 122 (see FIG. 12) to perform the processing in FIG. 16. In another aspect, a part or whole of the processing may be performed with a circuit element or hardware except for the circuit element. Because the pieces of processing in steps S10, S12, and S40 of FIG. 16 are described in above with reference to FIG. 13, the overlapping description is omitted.

In step S14A, control device 101 causes temperature sensor 79 adjacent to separation claw 71 to be adjusted to detect the surface temperature at heating rotator 60 in the portion facing separation claw 71.

In step S20A, control device 101 determines whether the surface temperature detected in step S14A is higher than a predetermined temperature. When determining that the surface temperature detected in step S14A is higher than the predetermined temperature (for example, 200° C.) (YES in step S20A), control device 101 switches the control to step S22A. When the surface temperature detected in step S14A is not higher than the predetermined temperature (NO in step S20A), control device 101 switches the control to step S30A.

In step S22A, control device 101 controls actuator 78 that drives separation claw 71 to be adjusted, and drives separation claw 71 to be adjusted in the direction separating from heating rotator 60.

In step S30A, control device 101 determines whether the surface temperature detected in step S14A is lower than the predetermined temperature (for example, 200° C.). When determining that the surface temperature detected in step S14A is lower than the predetermined temperature (YES in step S30A), control device 101 switches the control to step S32A. When the surface temperature is not lower than the predetermined temperature (NO in step S30A), control device 101 switches the control to step S40.

In step S32A, control device 101 controls actuator 78 that drives separation claw 71 to be adjusted, and drives separation claw 71 to be adjusted in a direction approaching heating rotator 60.

[Summary of Third Embodiment]

As described above, in fixing device 50 of the second embodiment, each of separation claws 71 is driven based on the temperature detected with temperature sensor 79. The temperature detected with temperature sensor 79 correlates with the degree of thermal expansion in each portion of heating rotator 60. That is, driving separation claw 71 according to the temperature detected with temperature sensor 79 means driving separation claw 71 according to the thermal expansion of heating rotator 60. In fixing device 50, separation gaps D1 to D5 (see FIG. 15) can be equalized irrespective of the degree of thermal expansion of heating rotator 60 by driving separation claw 71 based on the temperature output from temperature sensor 79.

Because temperature sensor 79 is cheaper than distance sensor 77 (see FIGS. 10 and 11), cost of fixing device 50 of the third embodiment is lower than that of fixing device 50 of the second embodiment.

<Fourth Embodiment>

Figure 17:
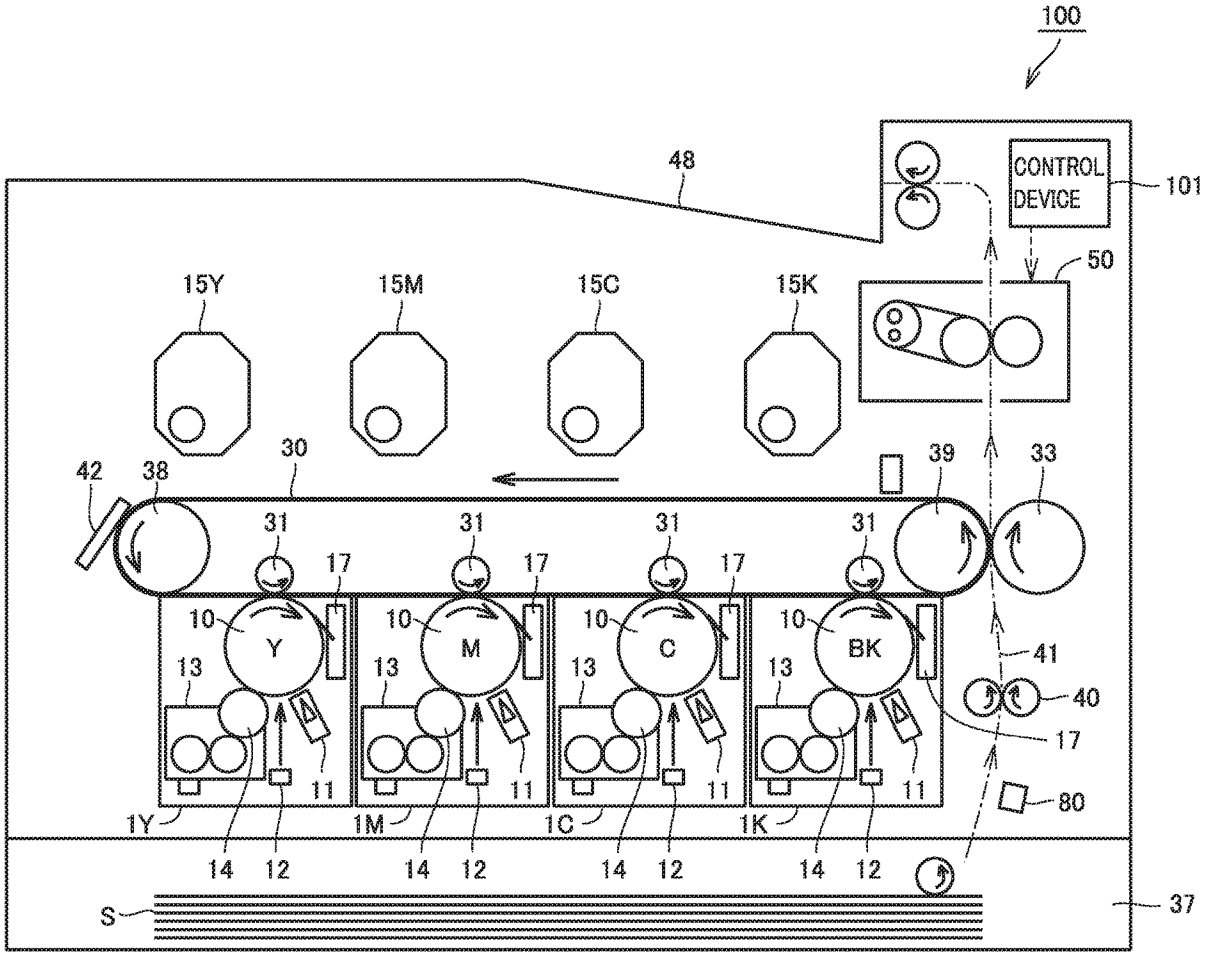
FIG. 17 is a block diagram illustrating a main hardware configuration of an image forming apparatus according to a fourth embodiment.

Referring to FIG. 17, a fixing device 50 according to a fourth embodiment will be described below. FIG. 17 is a block diagram illustrating a main hardware configuration of image forming apparatus 100 of the fourth embodiment.

As illustrated in FIG. 17, an image forming apparatus 100 of the fourth embodiment differs from image forming apparatus 100 (see FIG. 12) of the first to third embodiments in that image forming apparatus 100 of the fourth embodiment includes a sheet sensor 80 (detector) that detects a sheet size. Because other configurations are similar to those of image forming apparatus 100 of the first to third embodiments, the overlapping description is omitted.

Sheet sensor 80 is provided at any position in conveyance path 41 from cassette 37 to fixing device 50. Sheet sensor 80 detects a size of sheet S that passes through conveyance path 41. For example, sheet sensor 80 is a camera. The camera photographs currently-conveyed sheet S to produce an image of sheet S. The produced image is output to control device 101. Control device 101 specifies a sheet portion from the image using image processing technique such as edge detection processing, and detects the size of sheet S according to a size of the sheet portion.

As described above, when the small sheet takes the heat from sheet passing area A1 (see FIG. 4) when passing through fixing device 50. At this point, because the small sheet does not take the heat from sheet passing area A2 (see FIG. 4), the temperature at sheet passing area. A2 is higher than the temperature at sheet passing area A1. That is, when the small sheets are continuously printed, the degree of thermal expansion of sheet passing area A2 becomes larger than the degree of thermal expansion of sheet passing area A1.

In the case where the sheet size detected with sheet sensor 80 is the small size (second size), actuator 78 decreases the displacement of separation claw 71A1 (see FIG. 4) in the direction separating from heating rotator 60 to be smaller than the displacement of separation claw 71A2 (see FIG. 4) in the direction separating from heating rotator 60. Therefore, the differences among separation gaps D1 to D5 (see FIG. 4) are reduced.

Preferably, actuator 78 does not drive separation claw 71 until the number of printed small sheets exceeds a predetermined number of sheets (for example, 20 sheets) from the beginning of the printing. When the number of printed small sheets exceeds a predetermined number of sheets (for example, 20 sheets) from the beginning of the printing, actuator 78 decreases the displacement of separation claw 71A1 in the direction separating from heating rotator 60 to be smaller than the displacement of separation claw 71A2 in the direction separating from heating rotator 60.

Sometimes, a sheet size detecting function is mounted on a general image forming apparatus. In such cases, it is not necessary to newly provide sheet sensor 80. Fixing device 50 or image forming apparatus 100 is produced at low cost using the existing sheet size detecting function.

Although the embodiments of the present invention have been described, it is to be understood that, in all respects, the present disclosed embodiments are illustrative and not restrictive. The scope of the present invention is to be determined solely by the following claims, and includes the meanings equivalent to the claims and all the changes within the claims.

What is claimed is:

1. A fixing device configured to fix a toner image to a sheet by heat, the fixing device comprising:

a first rotator;

a second rotator contacting with a rotating surface of said first rotator;

a heating unit configured to heat said first rotator during operation of said first rotator such that the heat is transferred to said sheet passing through a first contact portion between said first rotator and said second rotator;

a plurality of separation members configured to separate said sheet from said first rotator such that said sheet passing through said first contact portion is not caught in said first rotator, said plurality of separation members being provided opposite to the rotating surface of said first rotator;

a holding member provided opposite to said first rotator, said plurality of separation members being provided in said holding member;

an abutment member provided in said holding member and in contact with said first rotator; and an adjustor, wherein said abutment member, said holding member, and said plurality of separation members operate in conjunction with a change in diameter of said first rotator at a second contact portion between said first rotator and said abutment member, the change in diameter of said first rotator being caused by thermal expansion of said first rotator which occurs when said heating unit heats said first rotator during the operation of said first rotator, wherein said adjustor, during the operation of said first rotator, limits a displacement of a first separation member of said plurality of separation members in a direction separating from said first rotator to be smaller than a displacement of a second separation member of said plurality of separation members in the direction, the displacement of the first separation member and the displacement of the second separation member being displacements which occur in accordance with the change in diameter of said first rotator during the operation of said first rotator, wherein said first separation member is provided opposite to a first area, said first area being an area through which a sheet of a first size passes at said first contact portion, and wherein said second separation member is provided opposite to a second area, said second area being an area through which a sheet of a second size larger than said first size passes at said first contact portion, and said second area being different from said first area.

2. The fixing device according to claim 1, wherein said adjustor comprises an obstruction member configured to obstruct the displacement of said first separation member such that a distance between said first separation member and said first rotator is not longer than a predetermined distance.

3. The fixing device according to claim 1, wherein said abutment member is in contact with both ends of the rotating surface of said first rotator.

4. The fixing device according to claim 1, further comprising:

a plurality of distance sensors, wherein each of said plurality of distance sensors is provided so as to correspond to any of said plurality of separation members to detect a distance between the corresponding separation member and said first rotator, wherein said adjustor includes a plurality of drivers, and wherein each of said plurality of drivers is provided so as to correspond to any of said plurality of separation members, and drives the corresponding separation member such that distances detected with said plurality of distance sensors are equal to each other.

5. The fixing device according to claim 1, further comprising:

a plurality of temperature sensors, wherein each of said plurality of temperature sensors is provided so as to correspond to any of said plurality of separation members to detect a surface temperature at said first rotator facing the corresponding separation member, wherein said adjustor includes a plurality of drivers, and wherein each of said plurality of drivers is provided so as to correspond to any of said plurality of separation members, and drives the corresponding separation member based on a temperature detected with each of said plurality of temperature sensors.

6. The fixing device according to claim 1, further comprising:

a detector configured to detect a size of said sheet, wherein when said detected size of said sheet is said second size, said adjustor limits the displacement of said first separation member in the direction to be smaller than the displacement of said second separation member in the direction.

7. An image forming apparatus configured to fix a toner image to a sheet by heat, the image forming apparatus comprising:

a first rotator;

a second rotator contacting with a rotating surface of said first rotator;

a heating unit configured to heat said first rotator during operation of said first rotator such that the heat is transferred to said sheet passing through a first contact portion between said first rotator and said second rotator;

a plurality of separation members configured to separate said sheet from said first rotator such that said sheet passing through said first contact portion is not caught in said first rotator, said plurality of separation members being provided opposite to the rotating surface of said first rotator;

a holding member provided opposite to said first rotator, said plurality of separation members being provided in said holding member;

an abutment member provided in said holding member and in contact with said first rotator; and an adjustor, wherein said abutment member, said holding member, and said plurality of separation members operate in conjunction with a change in diameter of said first rotator at a second contact portion between said first rotator and said abutment member, the change in diameter of said first rotator being caused by thermal expansion of said first rotator which occurs when said heating unit heats said first rotator during the operation of said first rotator, wherein said adjustor, during the operation of said first rotator, limits a displacement of a first separation member of said plurality of separation members in a direction separating from said first rotator to be smaller than a displacement of a second separation member of said plurality of separation members in the direction, the displacement of the first separation member and the displacement of the second separation member being displacements which occur in accordance with the change in diameter of said first rotator during the operation of said first rotator, wherein said first separation member is provided opposite to a first area, said first area being an area through which a sheet of a first size passes at said first contact portion, and wherein said second separation member is provided opposite to a second area, said second area being an area through which a sheet of a second size larger than said first size passes at said first contact portion, and said second area being different from said first area.

8. The image forming apparatus according to claim 7, wherein said adjustor comprises an obstruction member configured to obstruct the displacement of said first separation member such that a distance between said first separation member and said first rotator is not longer than a predetermined distance.

9. The image forming apparatus according to claim 7, wherein said abutment member is in contact with both ends of the rotating surface of said first rotator.

10. The image forming apparatus according to claim 7, further comprising:

a plurality of distance sensors, wherein each of said plurality of distance sensors is provided so as to correspond to any of said plurality of separation members to detect a distance between the corresponding separation member and said first rotator, wherein said adjustor includes a plurality of drivers, and wherein each of said plurality of drivers is provided so as to correspond to any of said plurality of separation members, and drives the corresponding separation member such that distances detected with said plurality of distance sensors are equal to each other.

11. The image forming apparatus according to claim 7, further comprising:

a plurality of temperature sensors, wherein each of said plurality of temperature sensors is provided so as to correspond to any of said plurality of separation members to detect a surface temperature at said first rotator facing the corresponding separation member, wherein said adjustor includes a plurality of drivers, and wherein each of said plurality of drivers is provided so as to correspond to any of said plurality of separation members, and drives the corresponding separation member based on a temperature detected with each of said plurality of temperature sensors.

12. The image forming apparatus according to claim 7, further comprising:

a detector configured to detect a size of said sheet, wherein when said detected size of said sheet is said second size, said adjustor limits the displacement of said first separation member in the direction to be smaller than the displacement of said second separation member in the direction.

* * * * *